US007782279B2

(12) United States Patent
Lee et al.

(10) Patent No.: US 7,782,279 B2
(45) Date of Patent: Aug. 24, 2010

(54) ORGANIC LIGHT EMITTING DIODE DISPLAY DEVICE AND DRIVING METHOD THEREOF

(75) Inventors: Jae Sung Lee, Suwon-si (KR); Chang Hoon Lee, Suwon-si (KR)

(73) Assignee: Samsung Mobile Display Co., Ltd., Yongin, Gyunggi-Do (KR)

( * ) Notice: Subject to any disclaimer, the term of this patent is extended or adjusted under 35 U.S.C. 154(b) by 0 days.

(21) Appl. No.: 12/126,767

(22) Filed: May 23, 2008

(65) Prior Publication Data

US 2008/0218457 A1 Sep. 11, 2008

Related U.S. Application Data

(63) Continuation of application No. 11/901,090, filed on Sep. 13, 2007.

(30) Foreign Application Priority Data

Oct. 12, 2006 (KR) ..... 10-2006-0099349

(51) Int. Cl.
*G09G 3/32* (2006.01)

(52) U.S. Cl. ..... 345/82; 345/76; 345/77; 345/204

(58) Field of Classification Search ..... 345/82, 345/76–77, 204
See application file for complete search history.

(56) References Cited

U.S. PATENT DOCUMENTS

| | | | | |
|---|---|---|---|---|
| 5,754,150 | A * | 5/1998 | Matsui | 345/89 |
| 7,479,953 | B2 * | 1/2009 | Toyoda et al. | 345/204 |
| 2005/0057191 | A1 * | 3/2005 | Jo et al. | 315/291 |
| 2007/0013725 | A1 * | 1/2007 | Burkhardt et al. | 345/690 |
| 2007/0085780 | A1 * | 4/2007 | Peng et al. | 345/76 |
| 2008/0239157 | A1 * | 10/2008 | Rai | 348/674 |

FOREIGN PATENT DOCUMENTS

| | | | |
|---|---|---|---|
| JP | 2005-269110 | * | 9/2005 |
| KR | 10-2003-0087588 | | 12/2003 |
| KR | 10-2004-0013204 | | 2/2004 |

* cited by examiner

*Primary Examiner*—Richard Hjerpe
*Assistant Examiner*—Leonid Shapiro
(74) *Attorney, Agent, or Firm*—Knobbe Martens Olson & Bear LLP

(57) ABSTRACT

An organic light emitting diode display device is disclosed. The device includes a brightness controller configured to selectively control a brightness controlling range based at least in part on the magnitude of the video data input in one frame, and a gamma correcting unit configured to control the portion of maximum luminance corresponding to full scale data based on one of first gamma correcting values and second gamma correcting values.

14 Claims, 4 Drawing Sheets

ORGANIC LIGHT EMITTING DIODE DISPLAY DEVICE AND DRIVING METHOD THEREOF

CROSS-REFERENCE TO RELATED APPLICATIONS

This application is a continuation of U.S. application Ser. No. 11/901,090, filed Sep. 13, 2007, entitled "Organic Light Emitting Diode Display Device and Driving Method Thereof," which claims the benefit of Korean Patent Application No. 10-2006-0099349, filed on Oct. 12, 2006, in the Korean Intellectual Property Office, the disclosure of which is incorporated herein by reference.

BACKGROUND

1. Field of the Invention

The field relates to an organic light emitting diode display device and a driving method thereof, and more particularly, to an organic light emitting diode display device and a driving method thereof capable of limiting brightness in accordance with a light-emitting area and making a light-emitting area in accordance with data signals 2. Description of the Related Technology Various flat panel display devices with reduced weight and volume as compared with a cathode ray tube have been developed. The flat panel display device uses, as a display region, a plurality of pixels arranged on a substrate in a matrix form and displays the pixels by selectively applying data signals to the pixels each connected to scan lines and data lines.

The flat panel display may be either a passive matrix type display device or an active matrix type display device. The active matrix type display device is capable of lighting pixels by selecting each pixel performance in terms of resolution, contrast, and operating speed.

Such a flat panel display device has been used as a display device for a portable information terminal, and the like such as a personal computer, a cellular phone, and a PDA, etc., or a monitor for various information apparatuses. Examples of such a flat panel display device include a LCD using a liquid crystal panel, an organic light emitting diode display device using an organic light-emitting diode, and a PDP using a plasma panel. Among others, an organic light emitting diode display device has been favored because of excellent capability of light-emitting efficiency, brightness and viewing angle and high speed response characteristic.

SUMMARY OF CERTAIN INVENTIVE ASPECTS

One aspect of the invention is an organic light emitting diode display device, comprising: i) a pixel unit including a plurality of pixels to display an image by receiving a plurality of scan signals, a plurality of light emitting controlling signals, and a plurality of data signals, ii) a scan driver to transmit the scan signals and the light emitting controlling signals to the pixel unit, iii) a data driver to generate the plurality of data signals using video data and to transmit the data signals to the pixel unit, iv) a brightness controller to output a brightness control signal controlling a brightness limiting range of the pixel unit based on the light emitting area of the pixel unit in accordance with a frame data which is the sum of the video data input in a frame and v) a gamma correcting unit to control a ratio of brightness to gray scale using any one of a first gamma correcting value and a second gamma correcting value, the gamma correcting unit comprising a first register to store the first gamma correcting value and a second register to store the second gamma correcting value and to select one of the first register and the second register according to the brightness controller.

In the above device, the second register may be selected when the brightness controller is on. In the above device, the time that the light emitting area emits light may be controlled in accordance with the magnitude of the frame data. In the above device, the second gamma correcting value may set brightness higher than the first gamma correcting value. In the above device, the scan driver may comprise a scan driving circuit to transmit the scan signals and a light emitting control driving circuit to transmit the light emitting controlling signals, and the brightness control signal controls the light emitting control driving circuit.

In the above device, the brightness controller may comprise a data summer to sum the data signals input for one frame period; a lookup table to store the brightness limiting range in accordance with the sum of the data signal; and a brightness control driver to output the brightness control signal by receiving the brightness limiting range from the lookup table in accordance with the data signals summed in the data summer.

In the above device, the pulse widths of the light emitting controlling signals output from the light emitting control driving circuit may be controlled by the brightness control signal. The above device may further comprise a power supply to supply power to the pixel unit. In the above device, the brightness limiting range may be to control the amount of current supplied to the pixel unit. In the above device, the amount of current may be controlled by the light emitting time of the pixels.

Another aspect of the invention is a driving method of an organic light emitting diode display device which controls brightness in accordance with the amount of current flowing in pixels, the method comprising: i) determining a brightness limiting range in accordance with a sum of gray scales of data signals input for one frame period (Step 1), ii) limiting brightness of the pixels based on the brightness limiting range (Step 2), and iii) gamma-correcting the data signals according to one of a first gamma correcting value and second gamma correcting value (Step 3).

In the above method, the first gamma correcting value may be selected when the brightness is not limited. In the above method, in Step 2, the brightness corresponding to the data signals corrected according to the second gamma correcting value may be corrected to be higher than the brightness corresponding to the data signals corrected according to the first gamma correcting value. In the above method, in Step 3, the brightness limiting range of the pixels may correspond to the light emitting time of the pixel.

DETAILED DESCRIPTION OF CERTAIN INVENTIVE EMBODIMENTS

Figure 1:
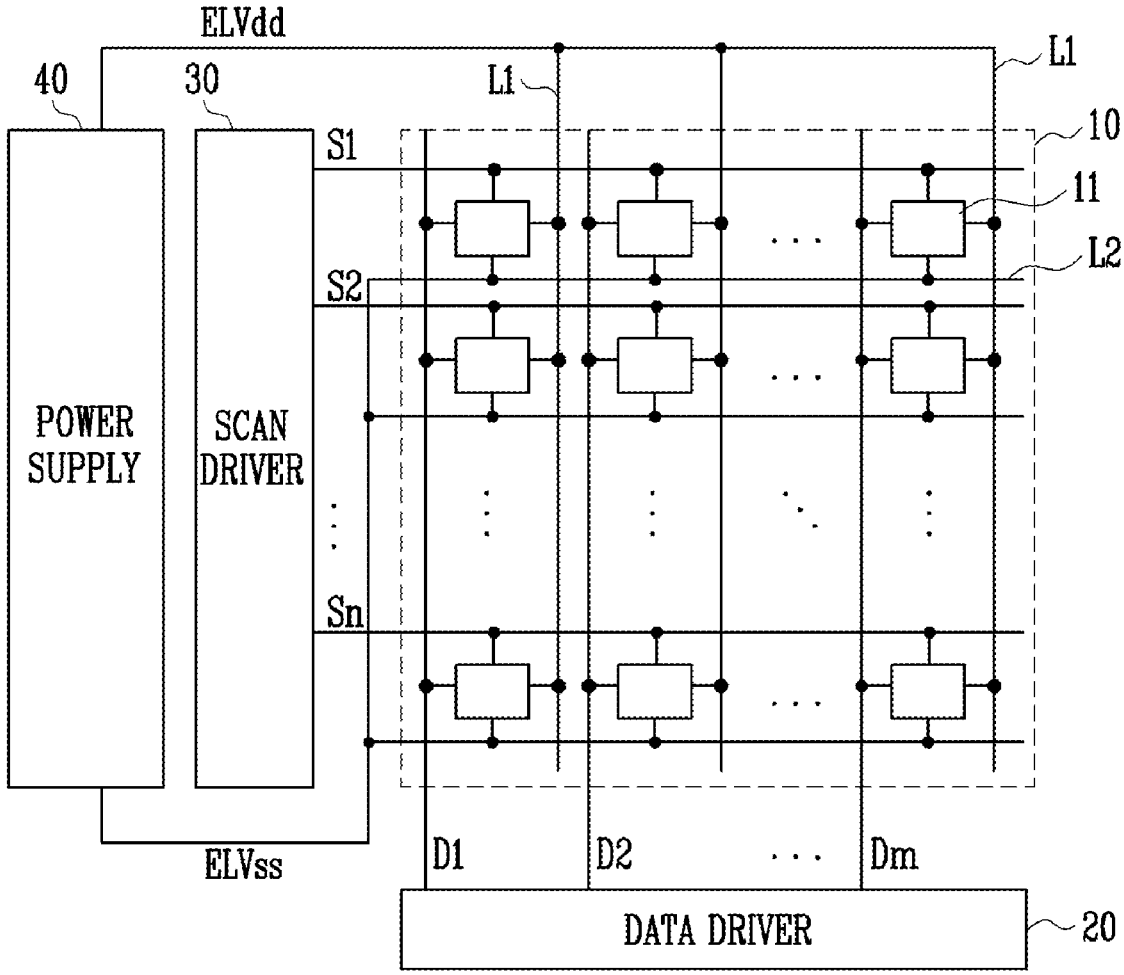
FIG. 1 is a schematic view illustrating a organic light emitting diode display device.

FIG. 1 is a structure view illustrating an organic light emitting diode display device. Referring to FIG. 1, an organic light emitting diode display device comprises a pixel unit 10, a data driver 20, a scan driver 30 and a power supply 40.

The pixel unit 10 is arranged with a plurality of pixels 11, wherein the respective pixels 11 are connected with light-emitting diodes (not shown). The pixel unit is arranged with n scan lines S1, S2, . . . Sn-1, Sn that are formed in row directions and transmit scan signals, m data lines D1, D2, . . . , Dm-1, Dm that are formed in column directions and transmit data signals; m first power supply lines L1 supplying a first power source, and m second power supply lines L2 transmit a second power source ELVss having potential lower than that of the first power source ELVdd. The pixel unit 10 displays images with the light-emitting diodes according to the scan signals, the data signals, the first power source ELVdd, and the second ELVss.

The data driver 20 is configured to apply the data signals to the pixel unit 10 and is connected to the data lines D1, D2, . . . Dm-1, Dm of the pixel unit 10 to apply the data signals to the pixel unit 10.

The scan driver 30 is configured to sequentially output the scan signals and is connected to the scan lines S1, S2, . . . Sn-1, Sn to transmit the scan signals to the specific rows of the pixel unit 10. The specific rows of the pixel unit 10 receiving the scan signals receive the data signals input from the data driver 20 to display the images. A frame is completed once all of the rows are sequentially selected and driven.

The power supply 40 transfers the first power ELVdd and the second power source ELVss having potential lower than that of the first power source ELVdd to the pixel unit 10 to allow current corresponding to the data signal to flow to the pixel unit 10 by voltage difference of the first power source ELVdd and the second power source ELVss.

Some organic light emitting diode display devices as described above require a large amount of current for the pixel unit 10 when displaying at a high level of brightness and requires a low amount of current for the pixel unit 10 when displaying at low brightness. The power supply 40 must be capable of supplying at least the current required for displaying high brightness.

Also, in case that there are many regions to be displayed at high brightness, all supplied from a common power source, a problem occurs that quality of the displayed image is degraded.

Figure 2:
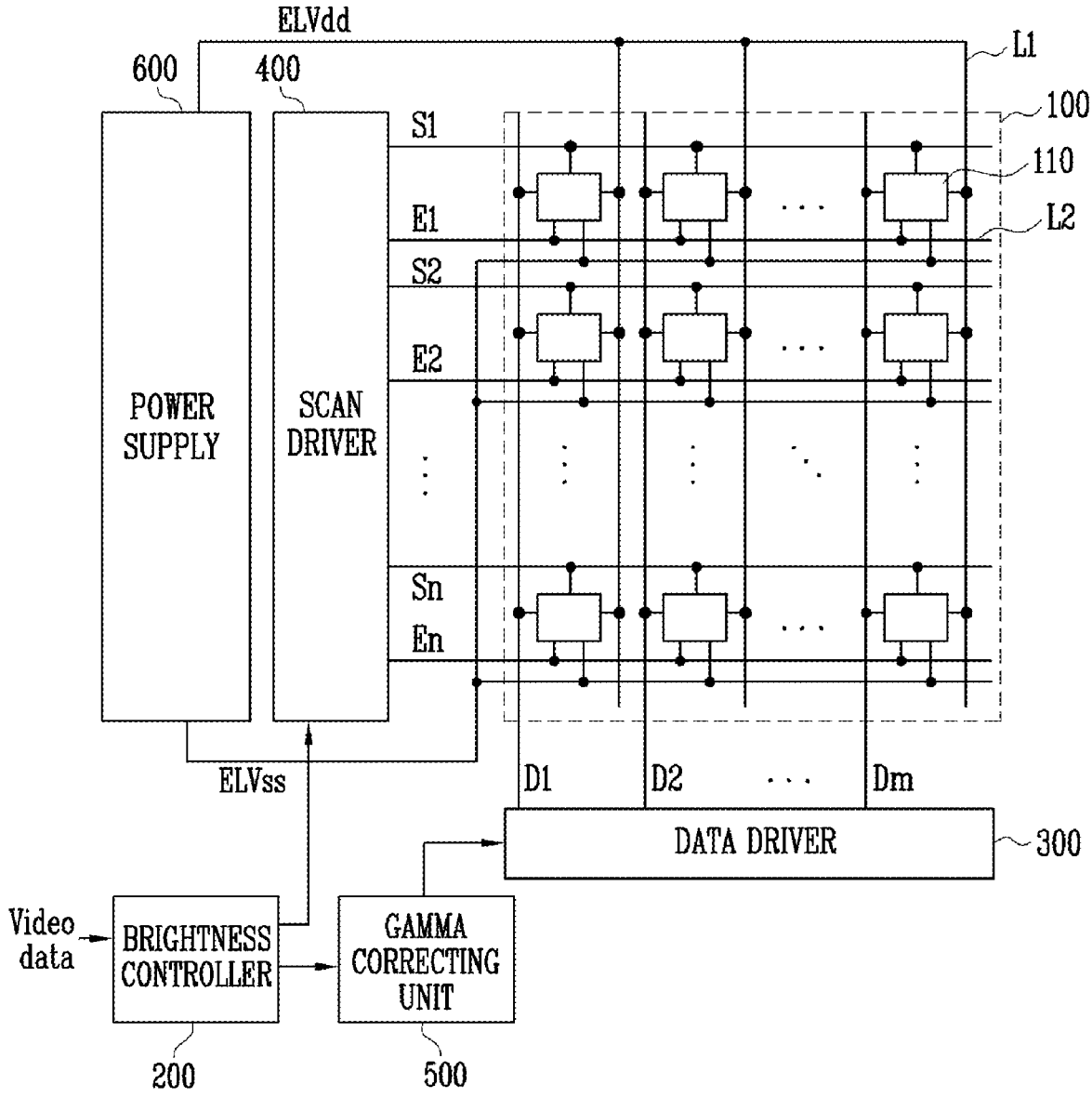
FIG. 2 is a schematic view illustrating an organic light emitting diode display device.

FIG. 2 is a schematic view illustrating an organic light emitting diode display device according to one embodiment. Referring to FIG. 2, an organic light emitting diode display device comprises a pixel unit 100, a brightness controller 200, a data driver 300, a scan driver 400, a gamma correcting unit 500 and a power supply 600.

The pixel unit 100 is arranged with a plurality of pixels 110, wherein the respective pixels 110 are connected with light-emitting diodes (not shown). The pixel unit is arranged with n scan lines S1, S2, . . . Sn-1, Sn that are formed in row directions and transmit scan signals, n light-emitting controlling signals lines E1, E2, . . . , En-1, En that are formed in column directions and transmit light-emitting controlling signals; m data lines D1, D2, . . . Dm-1, Dm that are formed in column directions and transmit data signals, a first power source line L1 that transmits a first power source ELVdd to the pixels, and a second power source line L2 that transmits a second power source ELVss to the pixels. The second power source L2 is equivalently represented and may be formed in the whole regions of the pixel unit 100 to be electrically connected to the respective pixels 110.

The brightness controller 200 outputs brightness controlling signals to limit brightness of the pixel unit 100 displaying images so that the brightness does not exceed a predetermined range. The brightness of the pixel unit 100 may be higher when the area at high brightness is large than when the area at high brightness is smaller However, when an area emitting light at high brightness is large, the pixel unit may advantageously be displayed with a lower brightness to save power.

The brightness can be changed in accordance with the change of the area emitting at high brightness by making the brightness limiting ranges depend on the area emitting at high brightness.

The brightness controller 200 determines the magnitude of the frame data that is the sum of video data input in one frame to determine if the magnitude of the frame data is large. The sum of the frame data gives an indication of the brightness of the frame. A high sum indicates a high brightness, and therefore a high current. Accordingly, the brightness controller 200 outputs the brightness controlling signals to limit brightness if the magnitude of the frame data signal is more than a threshold so that the brightness of the images displayed in the pixel unit 100 is reduced when displayed.

If the brightness of the pixel unit 100 is limited by the brightness controller 200, the amount of current flowing to the pixel unit 100 is limited so that high output of the power supply 500 is not needed. If the brightness of the pixel unit 100 is not limited, the light-emitting time of the light-emitting pixels may stay long in order to make the brightness high. In this situation, contrast ratio of the light-emitting pixel to the non-light-emitting pixel is large.

In another method of reducing the amount of current flowing to the pixel unit 100, the light-emitting time of the pixels is reduce so that the time of high current is reduced.

The brightness controller 200 controls the pulse widths of the light-emitting controlling signals transmitted through the light-emitting controlling signals lines E1, E2, . . . , En-1, En in order to control the light-emitting time of the pixel unit 100 and thus, controls the light-emitting time during the frame. If the pulse widths are long, the brightness controller 200 makes the amount of current flowing to the pixel unit 100 large so that the whole brightness of the pixel unit 100 is not reduced and if the pulse widths are short, it makes the amount of current flowing to the pixel unit 100 small so that the whole brightness of the pixel unit 100 is reduced.

The data driver 300 is configured to receive the video data having components of red, blue, and green, to generate the data signals, and to apply the data signals to the pixel unit 100. The data driver 300 is connected to the data lines D1, D2, . . . Dm-1, Dm of the pixel unit and is configured to apply the generated data signals to the pixel unit 100.

The scan driver 400 is configured to apply the scan signals and the light-emitting controlling signals to the pixel unit 100 and is connected to the scan lines S1, S2, . . . , Sn-1, Sn and the light-emitting controlling signal line E1, E2, . . . En-1, En to transmit the scan signals and the light-emitting controlling signals to the specific rows of the pixel unit 100. The pixel 110 receiving the scan signals receives the data signals output from the data driver 300 and the pixel 110 receives the light-emitting controlling signals and emits light according to light-emitting controlling signals.

The scan driver 400 comprises a scan driving circuit configured to generate the scan signals and a light-emitting driving circuit configured to generate the light-emitting controlling signals. The scan driving circuit and the light-emitting driving circuit may be included in one component or separated into independent components.

The specific rows of the pixel unit 100 receiving the scan signals receive the data signals input from the data driver 300 and the light-emitting diodes are supplied with current corresponding to the light-emitting controlling signals and the data signals. The image is displayed by turning on the light-emitting elements.

The gamma correcting unit 500 improves visibility by controlling the relationship of image data and brightness. The gamma correcting unit 500 receives the data signals of which the relationship of image data and brightness is nonlinear to make the ratio of gray scale to brightness linearly display. The gamma correcting unit comprises a register and uses gamma correcting values set in the register to control the relationship of image data and brightness. Further, the gamma correcting unit comprises a register operating when the brightness controller is off and a register operating when the brightness controller is on. As a result, the relationship of image data and brightness of the data signals is adjusted by using the gamma correcting values stored in the register when the brightness controller 200 is on so that it has much higher value when the brightness controller 200 is on if the same data signals are entered.

The power supply 600 transfers the first power source ELVdd and the second power source ELVss to the pixel unit 400 to supply current corresponding to the data signals in the respective pixels according to the difference between the first power source ELVdd and the second power source ELVss.

Figure 3:
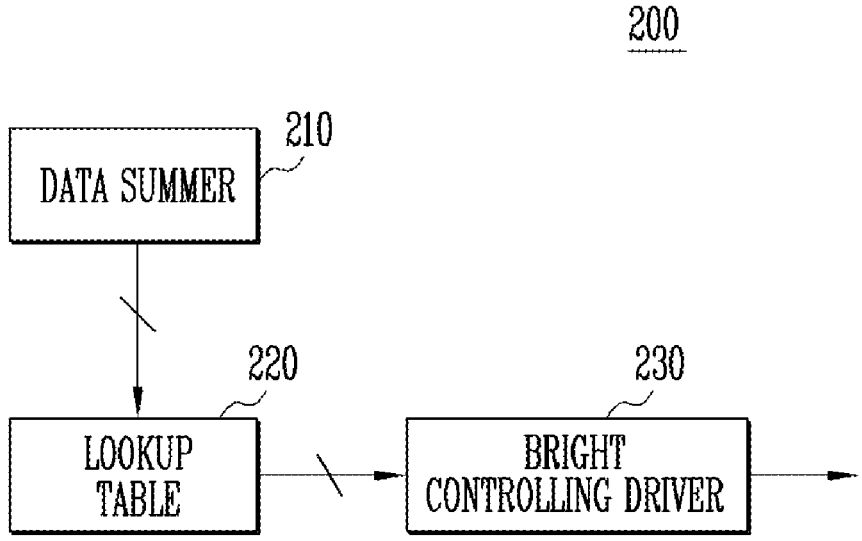
FIG. 3 is a schematic view illustrating one example of a bright controller adopted in an organic light emitting diode display device.

FIG. 3 is a schematic view illustrating one example of a bright controller adopted in an organic light emitting diode display device. Referring to FIG. 3, the brightness controller 200 comprises a data summer 210, a lookup table 220, and a bright controlling driver 230.

The data summer 210 extracts information on frame data by summing video data having information on red, blue, and green input in one frame. It can be appreciated that if the data value of the frame data is large, the frame data includes many data displaying high gray scale and if the data value of the frame data is small, it includes few data displaying high gray scale. That is, the light-emitting area can be determined based on the magnitude of the frame data. In some embodiments, the light-emitting area is defined by the following equation 1.

$$\text{Light-emitting_area} = \frac{\sum \text{one_frame_data}}{\text{brightness_of_pixel_unit_light_emitting_at_full_white}} \quad (100)$$

The lookup table 220 specifies the widths of the light-emitting intervals of the light-emitting controlling signals according to the summed value of the frame data for some embodiments. The widths of the light-emitting intervals may be specified using the upper bits of the frame data. The light-emitting area may be deduced using, for example, the upper 5 bits of the frame data.

When the brightness of the pixel unit 100 is gradually increased and arrives at brightness exceeding predetermined brightness, the brightness of the pixel unit 100 is limited. Also, as the brightness of the pixel unit 100 is increased, the brightness limiting rate is getting larger, preventing the brightness of the pixel unit 100 from being excessively increased If the brightness limiting rate is constant regardless of increasing the brightness of the pixel unit 100, when the pixel unit 100 displays very high brightness, the brightness is excessively limited so that a sufficiently bright screen can be provided, reducing brightness as a whole. Therefore, when the pixel unit 100 displays white as a whole, the brightness limiting range is set at maximum to prevent the brightness of the pixel unit 100 from being reduced below its limiting range.

In some embodiments, if the magnitude of the frame data does not exceed a predetermined magnitude, the brightness is not limited. As a result, when the brightness is not high, the brightness is not limited.

Table 1 indicates an example of the lookup table. It can be appreciated from the table 1 that the light-emitting ratio according to the number of pixels emitting light at brightness exceeding predetermined brightness is limited to 50% of a maximum value.

TABLE 1

| Upper 5 bit value | Frame Data as a portion of Full Scale | Portion of Maximum Luminance Corresponding to Full Scale Data. | Luminance | Width of Light emission control signal |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 100% | 300 | 325 |
| 6 | 22% | 100% | 300 | 325 |
| 7 | 25% | 100% | 300 | 325 |
| 8 | 29% | 100% | 300 | 325 |
| 9 | 33% | 100% | 300 | 325 |
| 10 | 36% | 100% | 300 | 325 |
| 11 | 40% | 99% | 297 | 322 |
| 12 | 43% | 98% | 295 | 320 |
| 13 | 47% | 96% | 287 | 311 |
| 14 | 51% | 93% | 280 | 303 |
| 15 | 54% | 89% | 268 | 290 |
| 16 | 58% | 85% | 255 | 276 |
| 17 | 61% | 81% | 242 | 262 |
| 18 | 65% | 76% | 228 | 247 |
| 19 | 69% | 72% | 217 | 235 |
| 20 | 72% | 69% | 206 | 223 |
| 21 | 76% | 65% | 196 | 212 |
| 22 | 79% | 62% | 186 | 202 |
| 23 | 83% | 60% | 179 | 194 |
| 24 | 87% | 57% | 172 | 186 |
| 25 | 90% | 55% | 165 | 179 |
| 26 | 94% | 53% | 159 | 172 |
| 27 | 98% | 51% | 152 | 165 |
| 28 | — | — | — | — |
| 29 | — | — | — | — |
| 30 | — | — | — | — |
| 31 | — | — | — | — |

If the frame data as a portion of full scale is 36% or less, the brightness is not limited and if the frame data as a portion of full scale exceeds 36%, the brightness is limited, so that when the frame data as a portion of full scale is increased, the brightness limiting rate is also increased. In order to prevent the brightness form being excessively limited, the brightness limiting rate is limited to 50% so that although most pixels of the pixel unit 100 emit light at maximum brightness, the brightness limiting rate should be 50% or less.

Table 2 indicates another example of the lookup table. It can be appreciated from the table 2 that the light-emitting ratio according to the number of pixels light-emitting at brightness exceeding predetermined brightness is limited to 33% of a maximum value.

TABLE 2

| Upper 5 bit value | Frame Data as a portion of Full Scale | Portion of Maximum Luminance Corresponding to Full Scale Data | Luminance | Width of Light emission control signal |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 99% | 298 | 322 |
| 6 | 22% | 98% | 295 | 320 |
| 7 | 25% | 95% | 285 | 309 |
| 8 | 29% | 92% | 275 | 298 |
| 9 | 33% | 88% | 263 | 284 |
| 10 | 36% | 83% | 250 | 271 |
| 11 | 40% | 79% | 237 | 257 |
| 12 | 43% | 75% | 224 | 243 |
| 13 | 47% | 70% | 209 | 226 |
| 14 | 51% | 64% | 193 | 209 |
| 15 | 54% | 61% | 182 | 197 |
| 16 | 58% | 57% | 170 | 184 |
| 17 | 61% | 53% | 160 | 173 |
| 18 | 65% | 50% | 150 | 163 |
| 19 | 69% | 48% | 143 | 155 |
| 20 | 72% | 45% | 136 | 147 |
| 21 | 76% | 43% | 130 | 141 |
| 22 | 79% | 41% | 124 | 134 |
| 23 | 83% | 40% | 119 | 128 |
| 24 | 87% | 38% | 113 | 122 |
| 25 | 90% | 36% | 109 | 118 |
| 26 | 94% | 35% | 104 | 113 |
| 27 | 98% | 34% | 101 | 109 |
| 28 | — | — | — | — |
| 29 | — | — | — | — |
| 30 | — | — | — | — |
| 31 | — | — | — | — |

If the frame data as a portion of full scale is 14% or less, the brightness is not limited and if the Frame Data as a portion of Full Scale exceeds 14%, the brightness is limited, so that when the area light-emitting at maximum brightness is increased, the brightness limiting rate is also increased. In order to prevent the brightness form being excessively limited, the brightness limiting rate is limited to 33% so that although most pixels of the pixel unit 100 emit light at maximum brightness, the brightness limiting rate should not be 33% or less. The light-emitting area indicated in tables 1 and 2 is calculated using the upper 5-bit value of one frame data.

The brightness controlling driver 230 receives the upper 5-bit value to output the brightness controlling signals. The brightness controlling signals are input to the scan driver 400 to control the scan driver 400 so that the scan driver 300 outputs the light-emitting controlling signals according to the brightness controlling signals. In particular, the brightness controlling signals are input to the light-emitting controlling circuit to output the light-emitting controlling signals in accordance with the brightness controlling signals.

In some embodiments, the maximum light-emitting intervals of light-emitting controlling signals are set to 325. Because 8 bits can represent 256 values and 9 bits can represent 512 numbers, in order to generate the light-emitting intervals of the light-emitting controlling signals as indicated in the table 1, it is preferable that the brightness controlling signals outputs 9-bit signals. The brightness controlling signals may use a start pulse and the widths of the light-emitting control signals may be determined.

Figure 4:
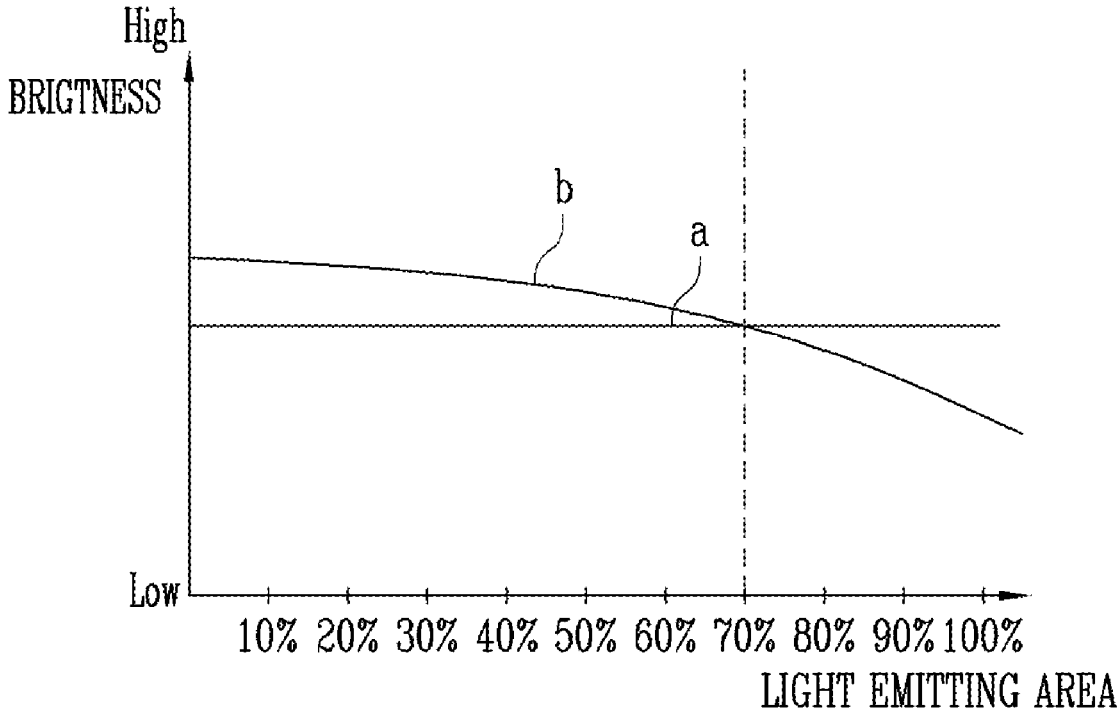
FIG. 4 is a view showing brightness variation in accordance with a light-emitting area.

FIG. 4 is a view showing maximum brightness in accordance with a light-emitting area. Referring to FIG. 4, a horizontal axis indicates a light-emitting area and a vertical axis indicates maximum brightness in accordance with a light-emitting area, wherein a indicates a case that maximum brightness is constant independent of a light-emitting area and b indicates a case that maximum brightness is changed in accordance with a light-emitting area, and maximum brightness is to be higher by using the gamma correcting values when a light-emitting area is small.

First, the case of a is a case that the brightness controller is off In this case, even though the light-emitting area is changed, the brightness is not changed. In the case that the brightness of the pixels is high, when the light-emitting area is small the pixels light-emitting at high brightness are not many so that power consumption is not large, however, when the light-emitting area is large the pixels light-emitting at high brightness is many that power consumption is large. Therefore, the power supply 600 is applied with considerable load so that it needs to have a large capacity. Also, when the light-emitting area is large, it can emit light at too high brightness so that dazzling phenomenon can be caused.

The case of b is a case that the brightness controller 200 is on. In the case of b, brightness values corresponding to gray scales are higher than that of the case of a, and the gamma correction is performed by using different gamma correcting values from gamma correcting values applied in the case of a. If, for example, the light-emitting area is 70% or more, the maximum brightness is lower than that of the case of a and if the light-emitting area is 70% or less, the maximum brightness is higher than that of a. The maximum brightness is to be high in portions that the light-emitting area is 70% or less. The brightness is to be high when the light-emitting area is small. The brightness of bright portions of dark portions and bright portions is very high to make brightness difference between the dark portions and the bright portions large so that contrast is increased. Accordingly, the bright portions of the images displayed on the pixel unit are displayed much brighter. And, if the brightness in the portions that the light-emitting area is 70% or more is to be low, the brightness is limited so that dazzling phenomenon is reduced.

Contrast is changed in accordance with the light-emitting area so that visibility is improved. Therefore, in some embodiments, the gamma correcting values are adjusted to change the brightness values, as shown in b. As a result, power consumption is reduced, contrast is increased, and visibility is improved.

Figure 5:
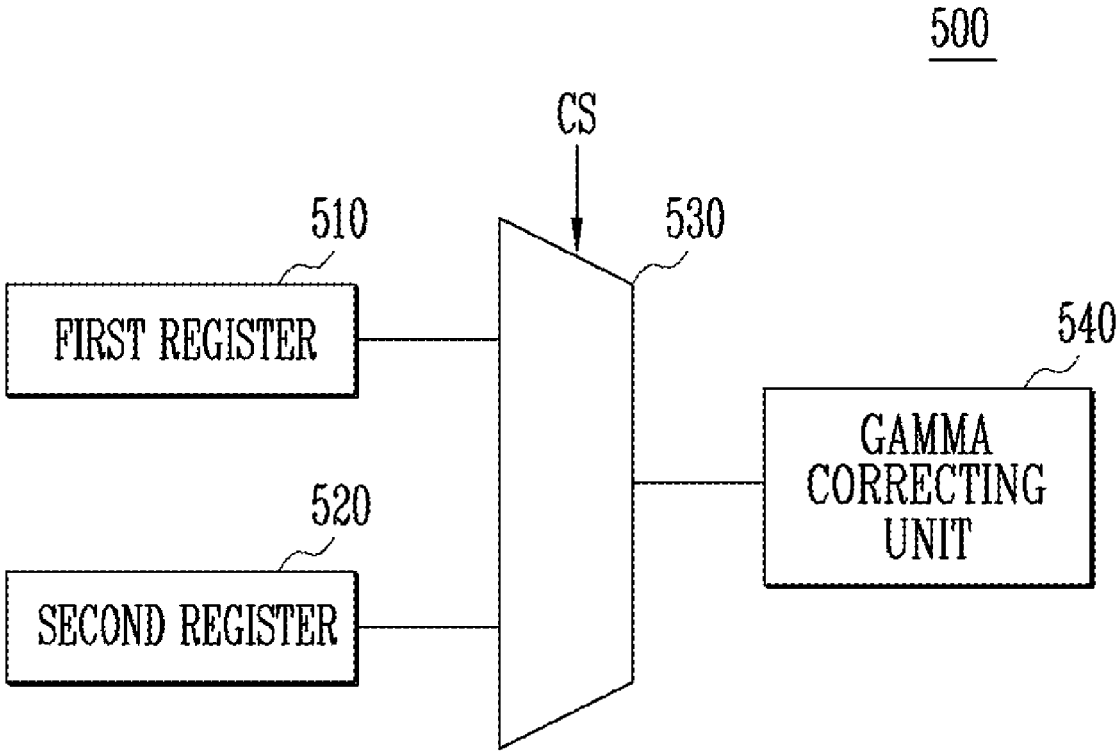
FIG. 5 is a schematic view illustrating a gamma correcting unit shown in FIG. 2.

FIG. 5 is a schematic view illustrating a gamma correcting unit shown in FIG. 2. Referring to FIG. 5, the gamma correcting unit 500 comprises a first register 510, a second register 520, a selector 530, and a gamma correcting circuit 540.

The first register 510 is configured to store first gamma correcting values of data signals and is selected to correct the data signals when the brightness controller is not operated. The first gamma correcting values are general correcting values for changing a nonlinearly input ratio of brightness of gray scale to a linear ratio of brightness of gray scale.

The second register 520 is configured to store second gamma correcting values of data signals and is selected to correct the data signals when the brightness controller 200 is operated. The data signals corrected by the second gamma correcting values stored in the second register 520 can display brightness higher than the data signals corrected by the firs gamma correcting values stored in the first register 510.

A selector 530 is configured to select either of the first register 510 and the second register 520 and can select one of the first register 510 and the second register 520 by using selecting signals from the brightness controller 200.

A gamma correcting circuit 540 is configured to control the ratio of brightness to gray scale and controls voltage difference among the data signals by receiving gamma correcting coefficients from one of the first register 510 or the second register 520, controlling the brightness corresponding to the gray scale.

With the organic light emitting diode display device and a driving method thereof, power consumption of the organic light emitting diode display device can be reduced and the maximum output of the power supply can be reduced to save its manufacturing cost. Also, contrast is increased to improve visibility.

Although a few embodiments have described using specific terminologies and examples, it would be appreciated by those skilled in the art that various modification and changes might be made in this embodiment without departing from the scope and spirit of the invention.

What is claimed is:

1. An organic light emitting diode display device, comprising:

a pixel unit including a plurality of pixels to display an image by receiving a plurality of scan signals, a plurality of light emitting controlling signals, and a plurality of data signals;

a scan driver to transmit the scan signals and the light emitting controlling signals to the pixel unit;

a data driver to generate the plurality of data signals using video data and to transmit the data signals to the pixel unit;

a brightness controller to output a brightness control signal controlling a brightness limiting range of the pixel unit based on the light emitting area of the pixel unit in accordance with a frame data which is the sum of the video data input in a frame; and a gamma correcting unit to control a ratio of brightness to gray scale using any one of a first gamma correcting value and a second gamma correcting value, the gamma correcting unit comprising a first register to store the first gamma correcting value and a second register to store the second gamma correcting value and to select one of the first register and the second register according to the brightness controller.

2. The organic light emitting diode display device according to claim 1, wherein the second register is selected when the brightness controller is on.

3. The organic light emitting diode display device according to claim 1, wherein the time that the light emitting area emits light is controlled in accordance with the magnitude of the frame data.

4. The organic light emitting diode display device according to claim 1, wherein the second gamma correcting value sets brightness higher than the first gamma correcting value.

5. The organic light emitting display device according to claim 1, wherein the scan driver comprises a scan driving circuit to transmit the scan signals and a light emitting control driving circuit to transmit the light emitting controlling signals, and the brightness control signal controls the light emitting control driving circuit.

6. The organic light emitting diode display device according to claim 1, wherein the brightness controller comprises a data summer to sum the data signals input for one frame period; a lookup table to store the brightness limiting range in accordance with the sum of the data signal; and a brightness control driver to output the brightness control signal by receiving the brightness limiting range from the lookup table in accordance with the data signals summed in the data summer.

7. The organic light emitting diode display device according to claim 5, wherein the pulse widths of the light emitting controlling signals output from the light emitting control driving circuit are controlled by the brightness control signal.

8. The organic light emitting diode display device according to claim 1, further comprising a power supply to supply power to the pixel unit.

9. The organic light emitting diode display device according to claim 1, wherein the brightness limiting range is to control the amount of current supplied to the pixel unit.

10. The organic light emitting diode display device according to claim 9, wherein the amount of current is controlled by the light emitting time of the pixels.

11. A driving method of an organic light emitting diode display device which controls brightness in accordance with the amount of current flowing in pixels, the method comprising:

determining a brightness limiting range in accordance with a sum of gray scales of data signals input for one frame period;

limiting brightness of the pixels based on the brightness limiting range; and gamma-correcting the data signals according to one of a first gamma correcting value and second gamma correcting value, according to the sum.

12. The driving method of the organic light emitting diode display device according to claim 11, wherein the first gamma correcting value is selected as a result of the brightness limiting range including only values which do not result in reduced brightness.

13. The driving method of the organic light emitting diode display device according to claim 11, wherein, the brightness corresponding to the data signals corrected according to the second gamma correcting value is corrected to be higher than the brightness corresponding to the data signals corrected according to the first gamma correcting value.

14. The driving method of the organic light emitting diode display device according to claim 11, wherein, the brightness limiting range of the pixels corresponds to the light emitting time of the pixel.

* * * * *